United States Patent [19]

Neusser et al.

[11] Patent Number: 4,728,918

[45] Date of Patent: Mar. 1, 1988

[54] STORAGE COIL WITH AIR GAP IN CORE

[75] Inventors: Paul Neusser; Werner Rössler, both of Munich, Fed. Rep. of Germany

[73] Assignee: Siemens Aktiengesellschaft, Berlin and Munich, Fed. Rep. of Germany

[21] Appl. No.: 761,649

[22] Filed: Aug. 2, 1985

[30] Foreign Application Priority Data

Sep. 24, 1984 [DE] Fed. Rep. of Germany ... 8428108[U]

[51] Int. Cl.[4] ..... H01F 17/06; H01F 27/24

[52] U.S. Cl. ..... 336/83; 336/155; 336/178

[58] Field of Search ..... 336/83, 134, 155, 165, 336/178, 135, 132, 133

[56] References Cited

U.S. PATENT DOCUMENTS

| | | | |
|---|---|---|---|
| 2,823,359 | 2/1958 | Wentworth | 336/135 X |
| 3,603,864 | 9/1971 | Thaler | 336/178 X |
| 3,631,534 | 12/1971 | Hirota et al. | 336/155 |
| 4,150,278 | 4/1979 | Resener | 336/83 X |
| 4,282,567 | 8/1981 | Voigt | 336/83 X |

FOREIGN PATENT DOCUMENTS

| | | | |
|---|---|---|---|
| 2209071 | 8/1973 | Fed. Rep. of Germany | 336/135 |
| 2203210 | 8/1973 | Fed. Rep. of Germany | 336/178 |
| 2805387 | 8/1979 | Fed. Rep. of Germany | 336/178 |
| 3123006 | 1/1983 | Fed. Rep. of Germany | 336/178 |
| 1114143 | 4/1956 | France | 336/134 |
| 1175256 | 3/1959 | France | 336/135 |
| 442849 | 11/1934 | United Kingdom | 336/135 |
| 449763 | 6/1936 | United Kingdom | 336/132 |
| 1341038 | 12/1973 | United Kingdom | 336/178 |

*Primary Examiner*—Thomas J. Kozma

*Attorney, Agent, or Firm*—Lawrence C. Edelman

[57] ABSTRACT

A storage coil for flux converters or low setting control elements is disclosed. The storage coil has a non-linear d-c bias characteristics associated with a ferrite core. The ferrite core may be a shell core, E core, RM core and U core, with an air gap formed between adjacent end faces of core parts, the adjacent end faces being oriented toward each other to provide a contact area without an air gap less than the overall cross-sectional area of the core and air gap of varying spacing occupying the area remaining between the contact area and the overall cross-sectional area.

5 Claims, 5 Drawing Figures

STORAGE COIL WITH AIR GAP IN CORE

BACKGROUND OF THE INVENTION

The invention relates to a storage coil including a magnetizable core of the type used for flux converters and low setting control elements, and in particular, it relates to a storage coil having a shell core, E core, RM core or U core, with an air gap formed between adjacent end faces of core parts.

Storage coils suitable for flux converters and low settings control elements are required to have a non-linear d-c bias characteristic. At low d-c bias, the inductance should be as high as possible, e.g. 150 uH, and at nominal load, i.e. for instance at 1 to 10 A, much lower, namely e.g. 30 uH. This requirement is not satisfied with ferrite cores with a constant air gap, that is with constant air gap height.

Examples of d-c bias characteristics which may be achieved in this manner are shown in FIG. 3 by the curves a and b respectively for an air gap of small gap height and large gap height or spacing. With a small air gap the inductance is indeed high at low d-c bias, but it decreases rapidly to values of less than 30 mH. With a large air gap height, only inductances of approximately 60 uH are reached at low d-c bias, as shown by the characteristic of curve b.

It is an object of the present invention to provide a storage coil including a magnetizable core which fulfills the stated requirements with respect to the non-linear d-c bias characteristic, at little expense.

SUMMARY OF THE INVENTION

For this purpose the invention provides, in a storage coil with a magnetizable core wherein the adjacent end faces e.g. of the central portions of shell cores, RM cores or E cores are oriented to face and rest against each other in an area corresponding to a portion of the total cross sectional area of the core while having an air gap of varying height or space for the remainder of the total cross sectional area of the core.

An aspect of the invention is the particular geometry selected for the contacting or non-air gap area and its size in relationship to that of the overall cross-sectional area of that region of the core. In a first illustrative embodiment of the invention the contacting area is circular, while in a second illustrative embodiment the contacting or non-air gap area is generally rectangular and has a predetermined width x. The area of the contacting portion is larger in the second illustrative embodiment than that in the first illustrative embodiment. In accordance with the value of x, various non-linear direct current bias characteristics are achieved.

BRIEF DESCRIPTION OF THE DRAWING

The foregoing and other objects, features and advantages will be more fully understood from the following detailed description of illustrative embodiments taken in conjunction with the accompanying drawing.

In the drawing.

DETAILED DESCRIPTION

Figure 1:
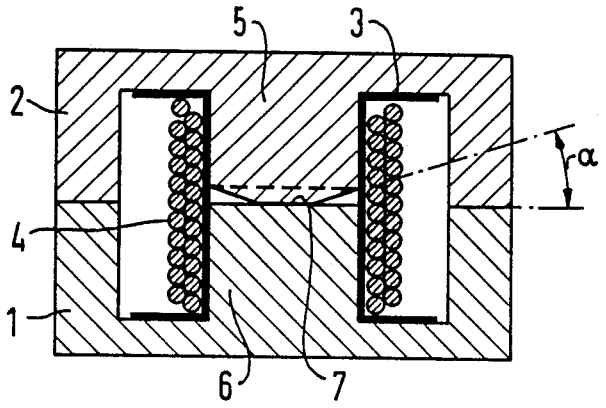
FIG. 1 shows an illustrative embodiment of a storage coil in accordance with the invention in schematic view depicted in cross section.
Figure 2:
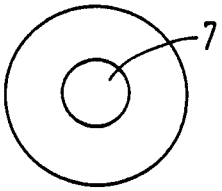
FIG. 2 is a plane view of the end face 7 of FIG. 1 formed according to the invention.

The storage coil according to FIGS. 1, 2 has a ferrite RM core with core halves 1, 2 formed with central portions 5, 6. A coil former 3 is placed on the central portions 5, 6 and carries windings 4 in its winding space.

The side of central portion 5 facing central portion 6 has the shape of a truncated cone. The flat surface 7 or top of this truncated cone rests on the end face of central portion 6 to provide contact therewith without air gap. The angle of the truncated cone may be in the range of 5 to 60 degrees, the angle alpha and the "contact area surface" 7 being selected to obtain a desired d-c bias characteristic.

Figure 3:
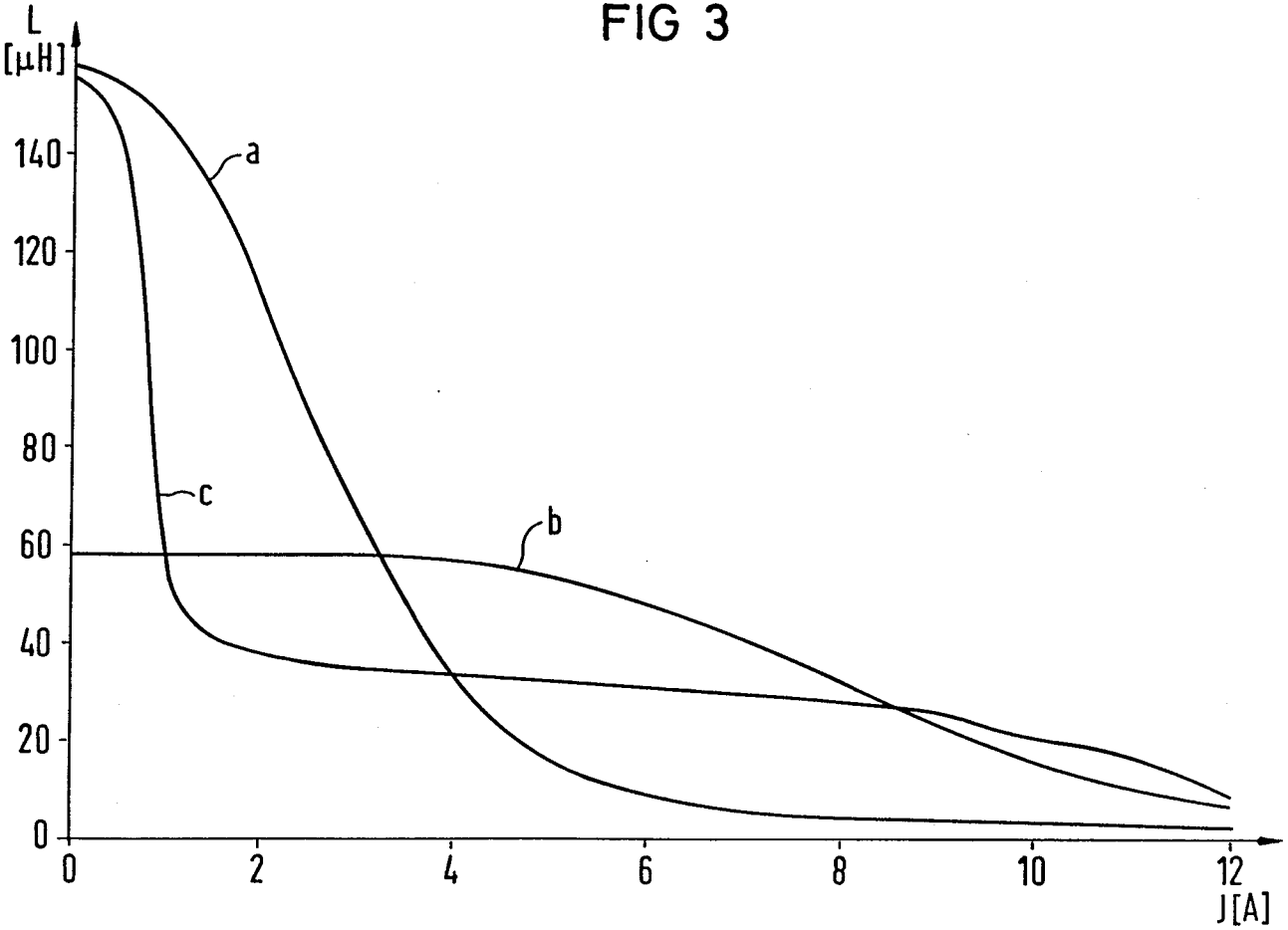
FIG. 3 illustrates d-c biasing characteristics of storage coils including curve c which is for the storage coil of FIGS. 1 and 2.

A typical d-c bias characteristic provided by a storage coil constructed according to FIGS. 1, 2 is shown for example, by curve c in FIG. 3. At a low d-c bias current for the horizontal abscissa, the inductance is in the desired range of about 150 uH and stays at an amount of about 30 uH over a wide current range.

Figure 4:
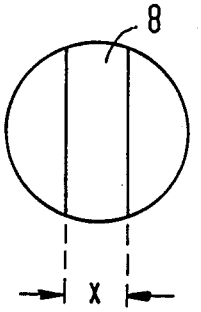
FIG. 4 is a top view, and a second illustrative embodiment of an end face, formed according to the inventive principles of a central portion of the storage coil according to FIG. 1.
Figure 5:
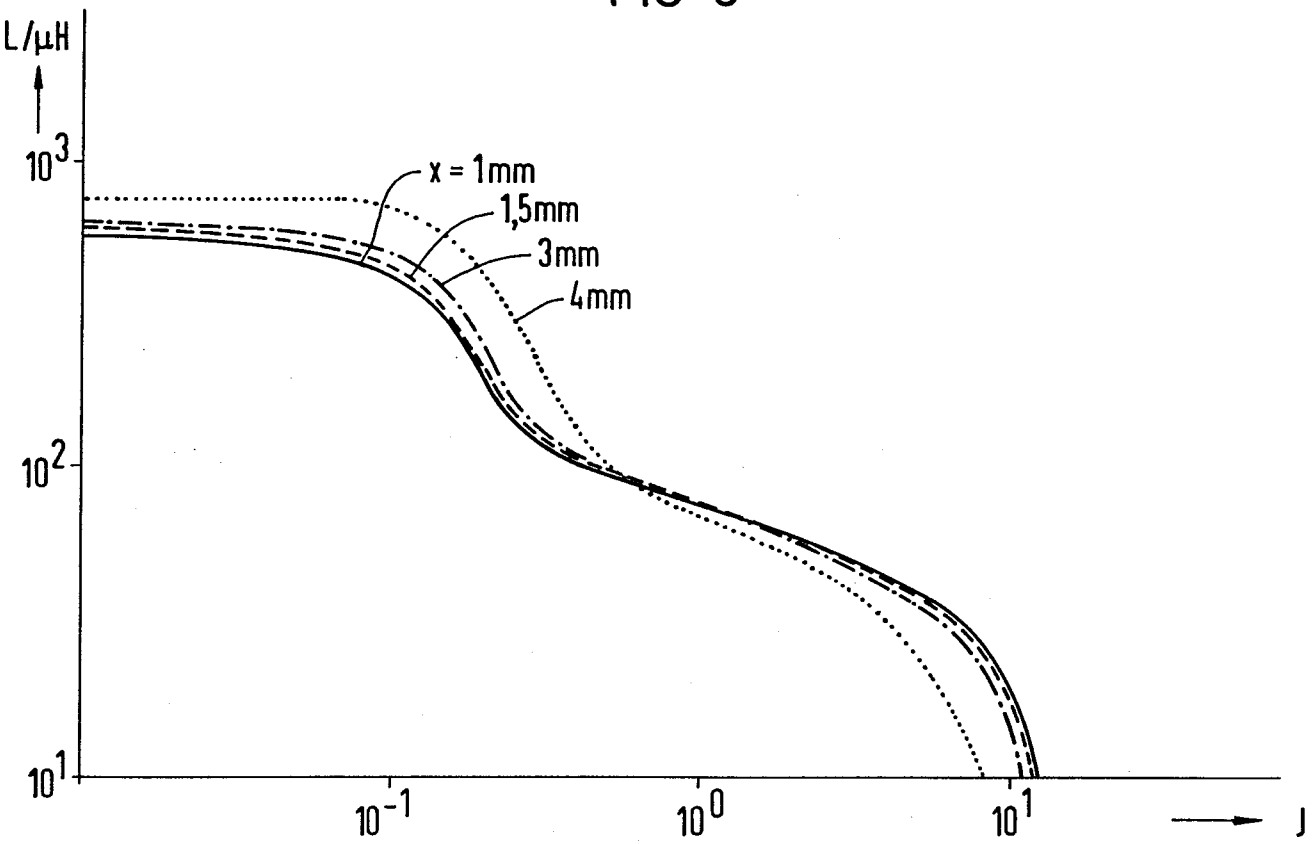
FIG. 5 illustrates d-c bias characteristics of storage coils with an air gap formed according to FIG. 4, for various areas without air gap.

The end faces turned toward each other, e.g. of the central portions of the cores may also have sloping or inclined planar regions. FIG. 4 shows an example for this, where 8 denotes the "planar" end face, which rests against the end face turned toward it of the adjacent central portion quasi without air gap. The degree of angle of slope and the width, marked "x", of the gapless region are again selected to provide the desired d-c bias characteristic. Examples of typical d-c bias characteristics obtained using an angle of 15° and widths x of 1; 1.5; 3 and 4 mm, respectively are shown in FIG. 5.

There has been shown and described a novel storage coil which fulfills all objects and advantages sought therefor. Many changes, modifications, variations and other uses and applications of the subject invention will, however, become apparent to those skilled in the art after considering the specification and the accompanying drawing which disclose preferred embodiment thereof. All such changes, modifications, variations and other uses and applications which do not depart from the spirit and scope of the invention are deemed to be covered by the invention which is limited only by the claims which follow.

What is claimed is;

1. A storage coil of the type used for flux converters and low setting control elements, having a non-linear d-c bias characteristic and magnetizable core parts, in particular a shell core, E core or RM core having a signal winding on central legs thereof and including an air gap formed between adjacent end faces of the central legs of said core parts, the inductance of said coil being substantially determined by said signal winding and said core, characterized in that in a region of said core where the adjacent end faces of said central legs are oriented toward each other, one of said end faces is completely planar and the other is only partially planar so that a central area of said region has a cross-sectional area less than the total cross-sectional area of said region and has no air gap between said end faces and the remaining area corresponding to the difference between said central area and said total cross-sectional area of said region has an air gap of varying height which is symmetricaly disposed about said central area irrespective of rotational positioning of said core parts with respect to each other.

2. A storage coil according to claim 1, wherein at least one of the mutually adjacent end face regions of the core parts has the form of a truncated cone.

3. A storage coil according to claim 1, wherein at least one of the mutually adjacent end face regions of the core parts is formed as a truncated cone having an angle in the range of five degrees to sixty degrees between the plane of the end face and the slope of the inclined portion producing the varying air gap space.

4. A storage coil according to claim 1, wherein at least one of the mutually adjacent end face regions of the core has inclined portions sloping away from the opposite sides of the first area.

5. A storage coil of the type used for flux converters and low setting control elements, having a non-linear d-c bias characteristic and magnetizable core parts, in particular a shell core, E core or Rectangular Modular core having a signal winding on central legs thereof and including an air gap formed between adjacent end faces of the central legs of said core parts, said central leg end faces being oriented in an opposed relationship toward each other, the inductance of said coil being substantially determined by said signal winding on said core, wherein:

one of said opposed end faces has a completely planar surface and the other of said opposed end faces has a surface with only a single, centrally located, planar portion so that in the area between said planar portions of said end faces no air gap exists and between the remaining portions of said opposing end faces an area having an air gap of varying height exists which is symmetrically disposed with respect to said area of no air gap irrespective of rotational positioning of said core parts with respect to each other.

* * * * *